US006615759B2

(12) United States Patent
Yaffe

(10) Patent No.: US 6,615,759 B2
(45) Date of Patent: Sep. 9, 2003

(54) FLEXIBLE VESSEL

(75) Inventor: Aaharon Yaffe, Moshav Amirim (IL)

(73) Assignee: Inbar-Water Distribution Company Ltd., Haifa (IL)

( * ) Notice: Subject to any disclaimer, the term of this patent is extended or adjusted under 35 U.S.C. 154(b) by 0 days.

(21) Appl. No.: 09/867,936

(22) Filed: May 29, 2001

(65) Prior Publication Data

US 2002/0053311 A1 May 9, 2002

Related U.S. Application Data

(60) Provisional application No. 60/208,388, filed on May 30, 2000.

(51) Int. Cl.[7] ..... B63B 25/12

(52) U.S. Cl. ..... 114/74 T; 114/256; 220/9.4; 220/560

(58) Field of Search ..... 114/256, 74 R, 114/74 T, 74 A; 220/560, 9.4

(56) References Cited

U.S. PATENT DOCUMENTS

| | | | | |
|---|---|---|---|---|
| 2,492,699 A | | 12/1949 | Houwink | |
| 3,067,712 A | | 12/1962 | Doerpinghaus | 114/74 |
| 3,477,401 A | | 11/1969 | Hayama | |
| 3,750,723 A | | 8/1973 | Schirtzinger | 141/388 |
| 3,779,196 A | | 12/1973 | Knaus et al. | 114/74 |
| 4,178,868 A | * | 12/1979 | Iizuka et al. | 114/74 R |
| 4,227,477 A | | 10/1980 | Preus | 114/256 |
| 4,399,768 A | | 8/1983 | Tokushima et al. | 118/423 |
| 4,881,482 A | | 11/1989 | Sandwith et al. | 114/256 |
| 5,010,837 A | | 4/1991 | Hirose | 114/256 |
| 5,235,928 A | | 8/1993 | Shank, Jr. | 114/244 |
| 5,355,819 A | | 10/1994 | Hsia et al. | 114/74 |
| 5,413,065 A | | 5/1995 | Spragg et al. | 114/256 |
| 5,425,323 A | | 6/1995 | Amundsen | 114/74 |
| 5,445,093 A | | 8/1995 | Lilly, Jr. | 114/45 |
| 5,488,921 A | | 2/1996 | Spragg | 114/256 |
| 5,657,714 A | | 8/1997 | Hsia et al. | 114/256 |
| 5,678,285 A | | 10/1997 | Germani | 24/418 |
| 5,971,039 A | | 10/1999 | Webb | 141/98 |
| 6,047,655 A | | 4/2000 | Cran | 114/74 |
| 6,082,931 A | | 7/2000 | Hopper | 405/218 |

FOREIGN PATENT DOCUMENTS

| | | |
|---|---|---|
| CA | 1321734 | 8/1993 |
| JP | 8058880 | 3/1996 |
| NO | 307097 | 3/2000 |

OTHER PUBLICATIONS

"A Sober Approach to the Water Crisis in the Middle East", by Jad Isaac, Applied Research Institute, Jerusalem, 2000.
"Drinking Water—Please Advice Needed", Norway, 1998.

* cited by examiner

*Primary Examiner*—Sherman Basinger
(74) *Attorney, Agent, or Firm*—Abelman, Frayne & Schwab

(57) ABSTRACT

Apparatus and a method for sea transport of liquids including a first enclosure, an at least partially flexible second enclosure disposed within the first enclosure and being adapted when filled, to generally fill the first enclosure, one of the first and second enclosures being a light liquid enclosure and the other of the first and second enclosures being a sea water enclosure, a light liquid port coupled to the light liquid enclosure for selectably filling it with a liquid lighter than sea water and a sea water port coupled to the sea water enclosure for selectably allowing sea water to fill it, thereby causing light liquid to be expelled against the force of gravity from the light liquid enclosure.

46 Claims, 11 Drawing Sheets

FLEXIBLE VESSEL

REFERENCE TO RELATED APPLICATIONS

This application is based on U.S. Provisional Patent Application Serial No. 60/208,388, filed on May 30, 2000 and entitled "Flexible Vessel".

FIELD OF THE INVENTION

The present invention relates to sea transportation vessels and methodologies generally and more particularly to vessels and methodologies for transport of liquids.

BACKGROUND OF THE INVENTION

The following U.S. Patents are believed to represent the current state of the art: U.S. Pat. Nos. 6,047,655; 5,971,039; 5,488,921; 5,445,093; 5,413,065; 5,355,819; 5,235,928; 5,010,837; 4,881,482; 4,399,768; 4,227,477; 3,779,196; 3,750,723; 3,067,712.

SUMMARY OF THE INVENTION

The present invention seeks to provide highly efficient and cost effective vessels and methodologies for sea transport of liquids.

There is thus provided in accordance with a preferred embodiment of the present invention an apparatus for sea transport of liquids. The apparatus includes a first enclosure, an at least partially flexible second enclosure disposed within the first enclosure and being adapted when filled, to generally fill the first enclosure, one of the first and second enclosures being a light liquid enclosure and the other of the first and second enclosures being a sea water enclosure, a light liquid port coupled to the light liquid enclosure for selectably filling it with a liquid lighter than sea water and a sea water port coupled to the sea water enclosure for selectably allowing sea water to fill it, thereby causing light liquid to be expelled against the force of gravity from the light liquid enclosure.

There is also provided in accordance with yet another preferred embodiment of the present invention a method for transport of liquids over seas. The method includes providing a vessel including a first enclosure and an at least partially flexible second enclosure disposed within the first enclosure and being adapted when filled, to generally fill the first enclosure, one of the first and second enclosures being a light liquid enclosure and the other of the first and second enclosures being an sea water enclosure, loading the vessel by selectably filling the light liquid enclosure with a liquid lighter than sea water and unloading the vessel by selectably allowing sea water to fill the sea water enclosure, hereby causing light liquid to be expelled against the force of gravity from the light liquid enclosure.

Further in accordance with a preferred embodiment of the present invention the first enclosure is a flexible enclosure. Preferably, the flexible enclosure includes a plurality of mutually spaced enclosure cross-section defining elements, which are joined by a tube of flexible material. Typically, the tube of flexible material is attached to the cross-section defining elements by means of an attachment assembly.

Still further in accordance with a preferred embodiment of the present invention the attachment assembly includes a tube attachment band overlapped with at least one portion of the flexible material and having a tensile strength greatly in excess of that of the flexible material, a plurality of spaced attachment straps joined at least to the at least one edge portion of the flexible material and to the attachment band and extending generally perpendicularly to the attachment band, the attachment straps having a tensile strength greatly in excess of that of the flexible material, a plurality of rings, each ring being engaged by one of the plurality of attachment, straps ring attachment straps interconnecting the plurality of rings and having a tensile strength greatly in excess of that of the flexible material.

Preferably, the cross-section defining elements are each formed with a plurality of hooks for engaging the rings.

Additionally in accordance with a preferred embodiment of the present invention the hooks and the rings are dimensioned so as to enable a ring to disengage from a hook only when not tensioned in a direction perpendicular to a plane of the cross-section defining elements.

Further in accordance with a preferred embodiment of the present invention the tube is an integral tube which extends along a length of the flexible enclosure.

Still further in accordance with a preferred embodiment of the present invention the tube includes a plurality of tube sections, each of which is attached at opposite edges thereof to a cross-section defining element.

Additionally in accordance with a preferred embodiment of the present invention the flexible enclosure is formed with at least one overpressure release assembly.

Further in accordance with a preferred embodiment of the present invention the light liquid enclosure and the sea water enclosure extend along generally the entire length of the first enclosure.

Still further in accordance with a preferred embodiment of the present invention the light liquid enclosure and the sea water enclosure are divided into a plurality of compartments extending serially along generally the entire length of the first enclosure.

Further in accordance with a preferred embodiment of the present invention the loading takes place principally by gravity and the unloading take place principally without requiring pumping.

Still further in accordance with a preferred embodiment of the present invention, during travel of the vessel from a loading location to an unloaded location, the vessel is nearly completely underwater.

There is also provided in accordance with a preferred embodiment of the present invention an apparatus for transport of liquids. The apparatus includes a flexible enclosure including a plurality of spaced, relatively rigid enclosure cross-section defining elements each pair of which are joined by a tube of flexible material.

There is further provided in accordance with yet another preferred embodiment of the present invention a method for water transport of fluids. The method includes providing a vessel including a flexible enclosure including a plurality of spaced, relatively rigid enclosure cross-section defining elements which are joined by a tube of flexible material, the flexible enclosure being formed to define therewithin first and second fluid enclosures, each of which may be filled to generally fill the flexible enclosure and thus empty the other, loading the vessel by selectably filling the first fluid enclosure of a first fluid and unloading the vessel by selectably allowing fluid to fill the second enclosure, thereby causing the second fluid to be expelled against the force of gravity from the first enclosure.

Further in accordance with a preferred embodiment of the present invention the flexible enclosure is formed to define therewithin first and second fluid enclosures, each of which may be filled to generally fill the flexible enclosure and thus empty the other.

Still further in accordance with a preferred embodiment of the present invention the tube of flexible material is attached to the cross-section defining elements by means of an attachment assembly. Preferably, the attachment assembly includes a tube attachment band overlapped with at least one portion of the flexible material and having a tensile strength greatly in excess of that of the flexible material, a plurality of spaced attachment straps joined at least to the at least one edge portion of the flexible material and to the attachment band and extending generally perpendicularly to the attachment band, the attachment straps having a tensile strength greatly in excess of that of the flexible material, a plurality of rings, each ring being engaged by one of the plurality of attachment straps, ring attachment straps interconnecting the plurality of rings and having a tensile strength greatly in excess of that of the flexible material.

Typically, the cross-section defining elements are each formed with a plurality of hooks for engaging the rings.

Additionally in accordance with a preferred embodiment of the present invention the hooks and the rings are dimensioned so as to enable a ring to disengage from a hook only when not tensioned in a direction perpendicular to a plane of the cross-section defining elements.

Further in accordance with a preferred embodiment of the present invention the tube is an integral tube, which extends along a length of the flexible enclosure.

Still further in accordance with a preferred embodiment of the present invention the tube includes a plurality of tube sections, each of which is attached at opposite edges thereof to a cross-section defining element.

Additionally in accordance with a preferred embodiment of the present invention the flexible enclosure is formed with at least one overpressure release assembly.

Preferably, the first and second enclosures extend along generally the entire length of the first enclosure.

Alternatively, the first and second enclosures are divided into a plurality of compartments extending serially along generally the entire length of the first enclosure.

Further in accordance with a preferred embodiment of the present invention the tube of flexible material is attached to the cross-section defining elements by means of an attachment assembly.

Preferably, the attachment assembly includes a tube attachment band overlapped with at least one portion of the flexible material and having a tensile strength greatly in excess of the of the flexible material, a plurality of spaced attachment straps joined at least to the at least one edge portion of the flexible material and to the attachment band and extending generally perpendicularly to the attachment band, the attachment straps having a tensile strength greatly in excess of that of the flexible material, a plurality of rings, each ring being engaged by one of the plurality of attachment straps, ring attachment straps interconnecting the plurality of rings and having a tensile strength greatly in excess of that of the flexible material.

Further in accordance with a preferred embodiment of the present invention the cross-section defining elements are each formed with a plurality of hooks for engaging the rings.

Preferably, the hooks and the rings are dimensioned so as to enable a ring to disengage from a hook only when not tensioned in a direction perpendicular to a plane of the cross-section defining elements.

Further in accordance with a preferred embodiment of the present invention the tube is an integral tube which extends along a length of the flexible enclosure.

Still further in accordance with a preferred embodiment of the present invention the tube includes a plurality of tube sections, each of which is attached at opposite edges thereof to a cross-section defining element.

Preferably, the flexible enclosure is formed with at least one overpressure release assembly.

Further in accordance with a preferred embodiment of the present invention the loading takes place principally by gravity and the unloading take place principally without requiring pumping.

Still further in accordance with a preferred embodiment of the present invention, during travel of the vessel from a loading location to an unloaded location, the vessel is nearly completely underwater.

Additionally, in accordance with a preferred embodiment of the present invention the first enclosure is a flexible enclosure. Preferably, the flexible enclosure includes a plurality of mutually spaced enclosure cross-section defining elements, which are joined by a tube of flexible material.

Further in accordance with a preferred embodiment of the present invention the light liquid enclosure and the sea water enclosure extends along generally the entire length of the first enclosure.

Additionally in accordance with a preferred embodiment of the present invention the light liquid enclosure and the sea water enclosure are divided into a plurality of compartments extending serially along generally the entire length of the first enclosure.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
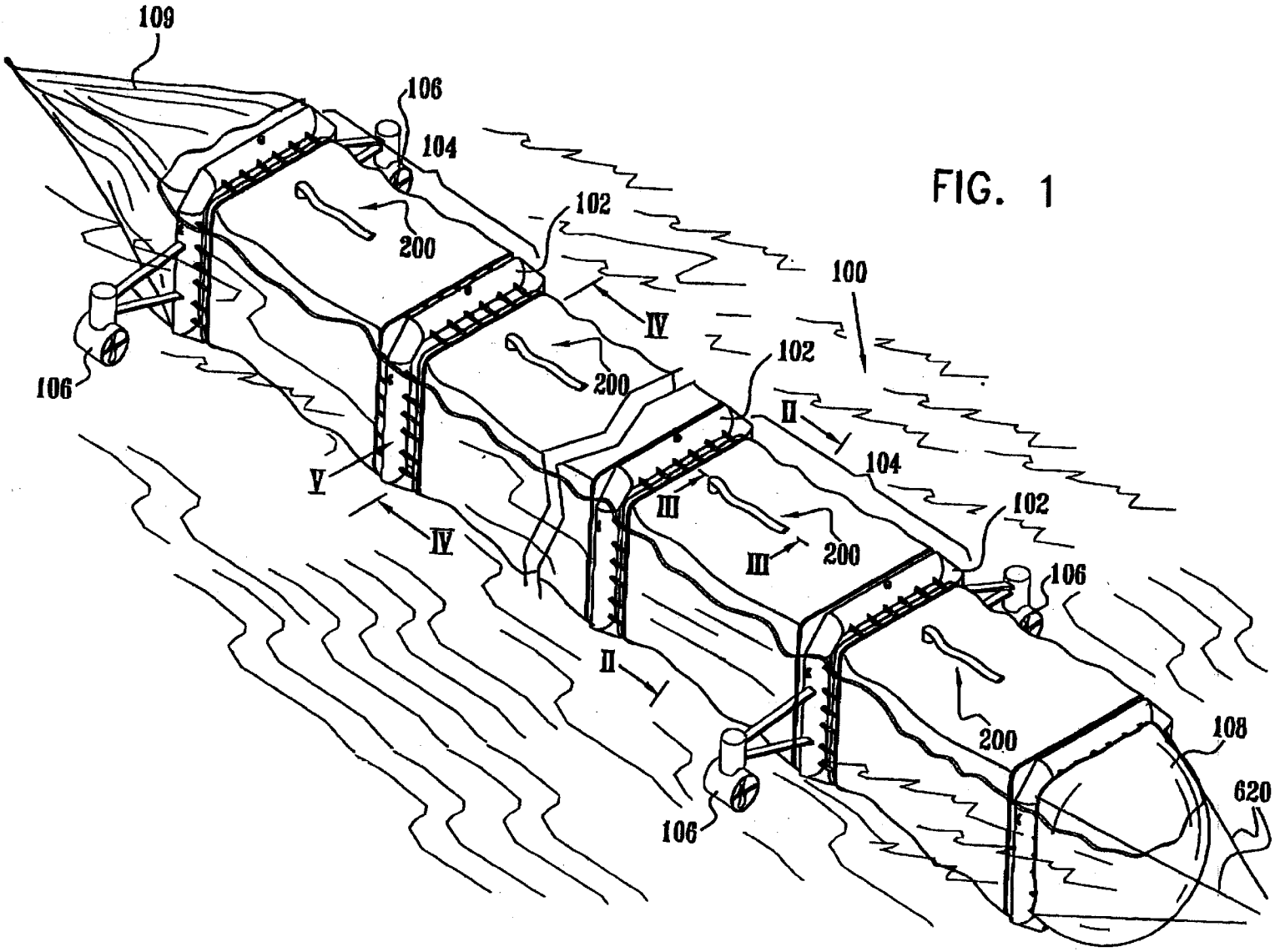
FIG. 1 is a pictorial illustration of apparatus for sea transport of liquids constructed and operative in accordance with a preferred embodiment of the present invention.

Reference is now made to FIG. 1, which is a pictorial illustration of apparatus for sea transport of liquids, constructed and operative in accordance with a preferred embodiment of the present invention. As seen in FIG. 1, there is provided a vessel 100 for transport of liquids comprising a flexible enclosure including a plurality of spaced, relatively rigid enclosure cross-section defining elements 102, each pair of which are joined by a tube of flexible material 104. In accordance with a preferred embodiment of the present invention, submarine thrusters 106 may be provided on two sides of one or more enclosure cross-section defining elements 102 for maintaining desired mutual orientation thereof and maintaining the vessel in a generally linear orientation. Thrusters 106 may also be helpful in driving and braking the vessel.

It is a particular feature of the present invention that the vessel has a hemispherical forward end 108 and a generally conical rearward end 109, both of which are preferably filled with a mixture of fresh water and seawater.

Figure 2A:
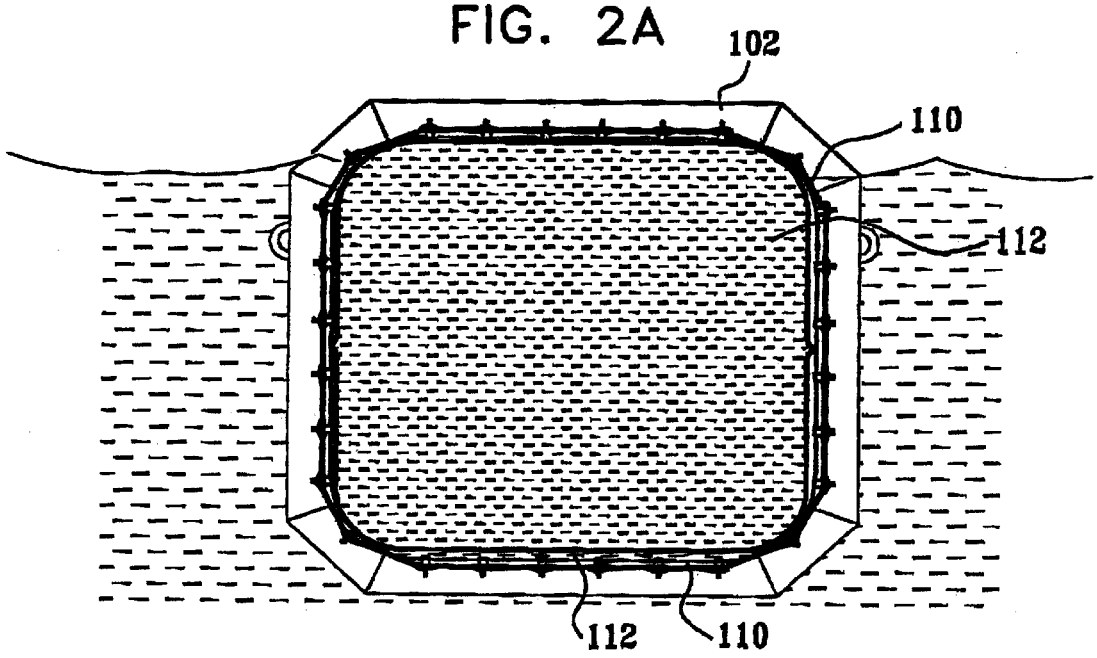
FIG. 2A is a sectional illustration taken along lines II—II in FIG. 1 showing the apparatus of FIG. 1 during fresh water transport in accordance with a first embodiment of the present invention.
Figure 2B:
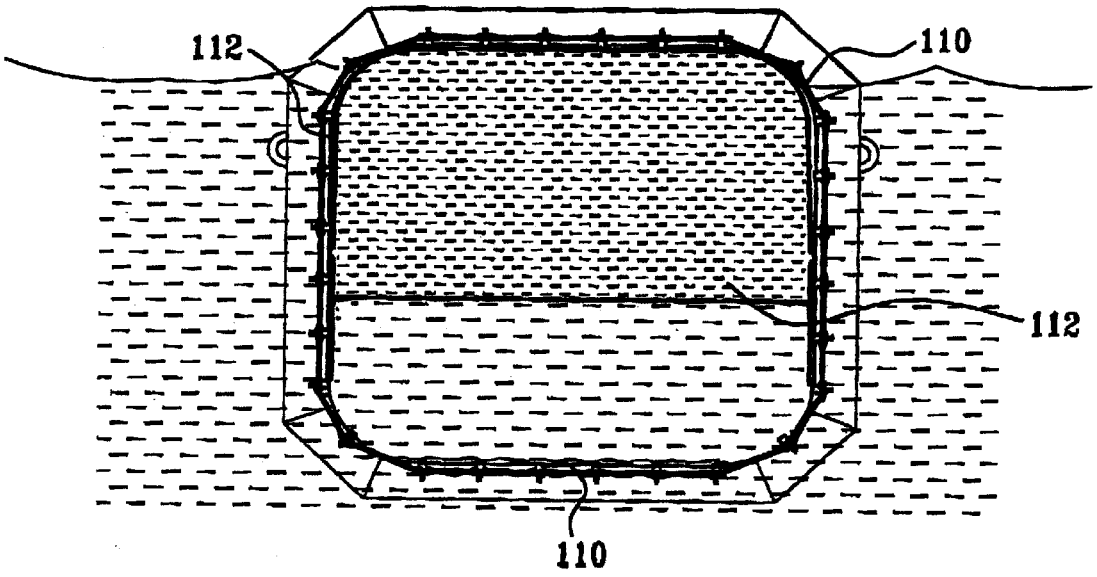
FIG. 2B is a sectional illustration taken along lines II—II in FIG. 1 showing the apparatus of FIG. 1 during sea water ballast transport in accordance with a first embodiment of the present invention.

Referring additionally to FIGS. 2A and 2B, in accordance with a first preferred embodiment of the present invention, the flexible enclosure includes a first, outer enclosure 110 and an at least partially flexible second enclosure 112 disposed within the first enclosure 110 and being adapted, when filled as shown in FIG. 2A, to generally fill the first enclosure 110.

Preferably, the second enclosure 112 is employed as a relatively light liquid enclosure and the first enclosure 110 is a sea water enclosure. Thus, it may be appreciated that when a light liquid, such as fresh water, which is lighter than sea water, is being transported, the second enclosure 112 generally fills the first enclosure 110, as shown in FIG. 2A. When the vessel 100 is engaged in sea water ballast transport, the second enclosure 112 is empty and is forced against the upper walls of the first enclosure 110, as shown in FIG. 2B.

Figure 2C:
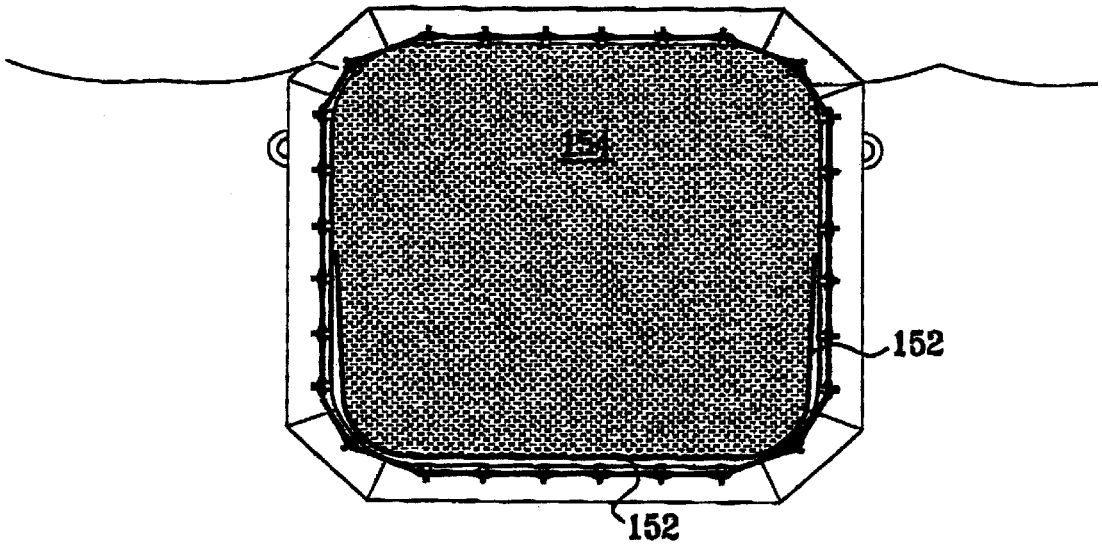
FIG. 2C is a sectional illustration taken along lines II—II in FIG. 1 showing the apparatus of FIG. 1 during fresh water transport in accordance with a second embodiment of the present invention.
Figure 2D:
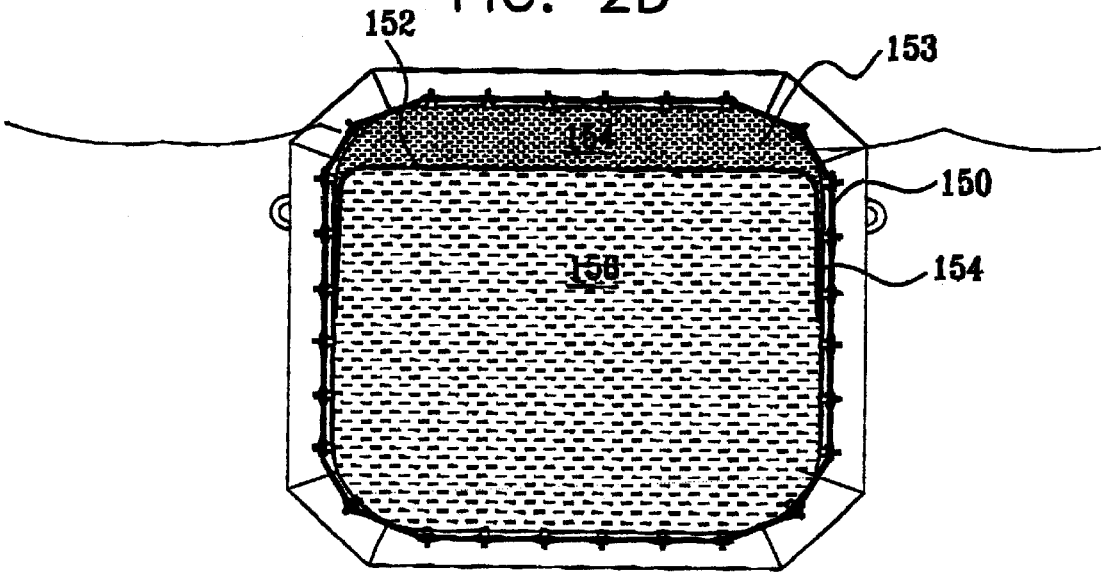
FIG. 2D is a sectional illustration taken along lines II—II in FIG. 1 showing the apparatus of FIG. 1 during sea water ballast transport in accordance with a second embodiment of the present invention.

Referring additionally to FIGS. 2C and 2D, in accordance with a second preferred embodiment of the present invention, the flexible enclosure includes an outer enclosure 150 and an at least partially flexible diaphragm 152 disposed with the first enclosure 150 and being adapted to divide the outer enclosure 150 into a light liquid containing sub-enclosure 154 and a sea water containing sub-enclosure 156. When the light liquid containing sub-enclosure 154 is filled as shown in FIG. 2C, diaphragm 152 is positioned against the lower inside wall portion of the outer enclosure 150 such that the light liquid containing sub-enclosure 154 generally fills the outer enclosure 150.

When the vessel 100 is engaged no sea water ballast transport (FIG. 2D), the first sub-enclosure 154 is generally empty and the diaphragm 152 is positioned close to the upper inside wall portion of the outer enclosure 150 such that the sea water containing sub-enclosure 156 generally fills the outer enclosure 150.

FIG. 2D further shows that during sea water transportation, the upper portion of the flexible enclosure preferably contains a volume of fresh water 153, which is required to preserve the buoyancy of the vessel 100.

Figure 3A:
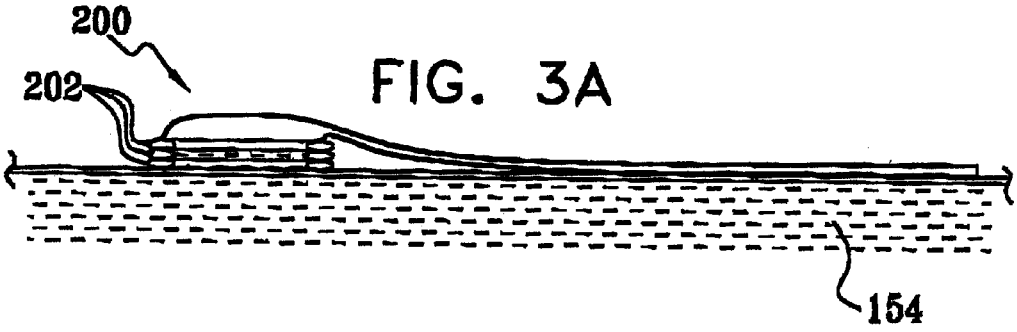
FIG. 3A is a sectional illustration taken along lines III—III in FIG. 1 showing a pressure relief mechanism forming part of the apparatus of FIG. 1 in a first operative orientation.
Figure 3B:
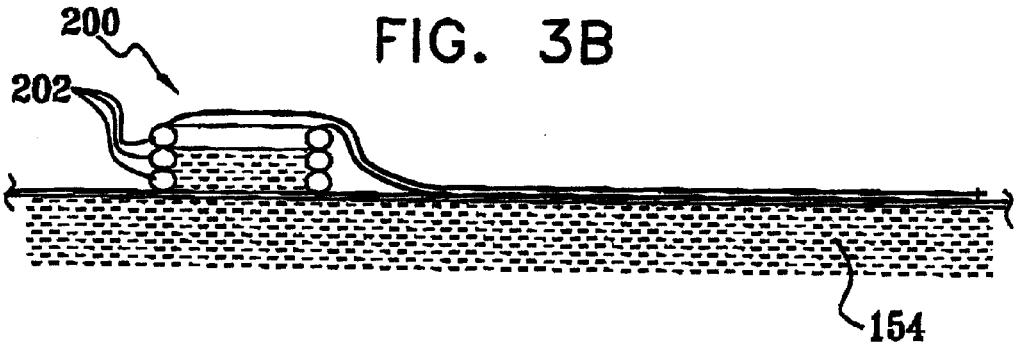
FIG. 3B is a sectional illustration taken along lines III—III in FIG. 1 showing the pressure relief mechanism forming part of the apparatus of FIG. 1 in a second operative orientation.
Figure 3C:
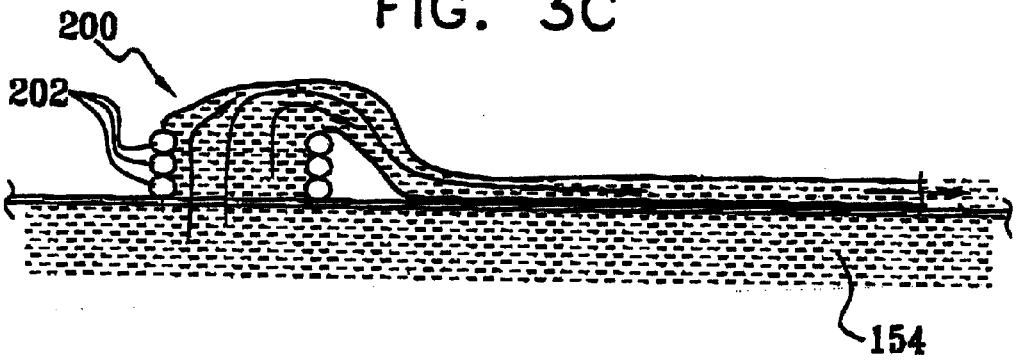
FIG. 3C is a sectional illustration taken along lines III—III in FIG. 1 showing the pressure relief mechanism forming part of the apparatus of FIG. 1 in a third operative orientation.

Reference is now made to FIGS. 3A, 3B and 3C, which are sectional illustrations taken along lines III—III in FIG. 1 showing a pressure relief mechanism forming part of the apparatus of FIG. 1 in first, second and third operative orientations. The pressure relief mechanism preferably comprises a conduit 200 having selectably inflatable wall portions 202. FIG. 3A shows the conduit in a non-inflated state, while FIG. 3B shows the conduit in an inflated state, it being appreciated that the event to which the conduit is inflated determines the pressure relief threshold of the mechanism.

FIG. 3C shows a situation wherein pressure relief is realized by fluid leaving the enclosure via the conduit 200.

Figure 5:
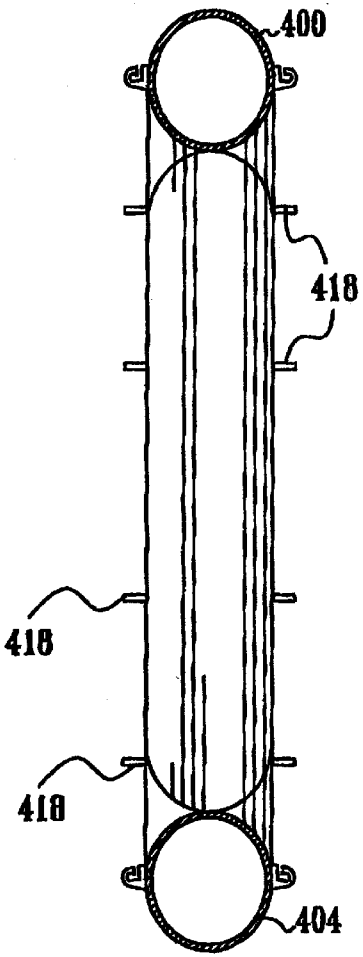
FIG. 5 is a sectional illustration taken along lines V—V in FIGS. 1 and 4.
Figure 4:
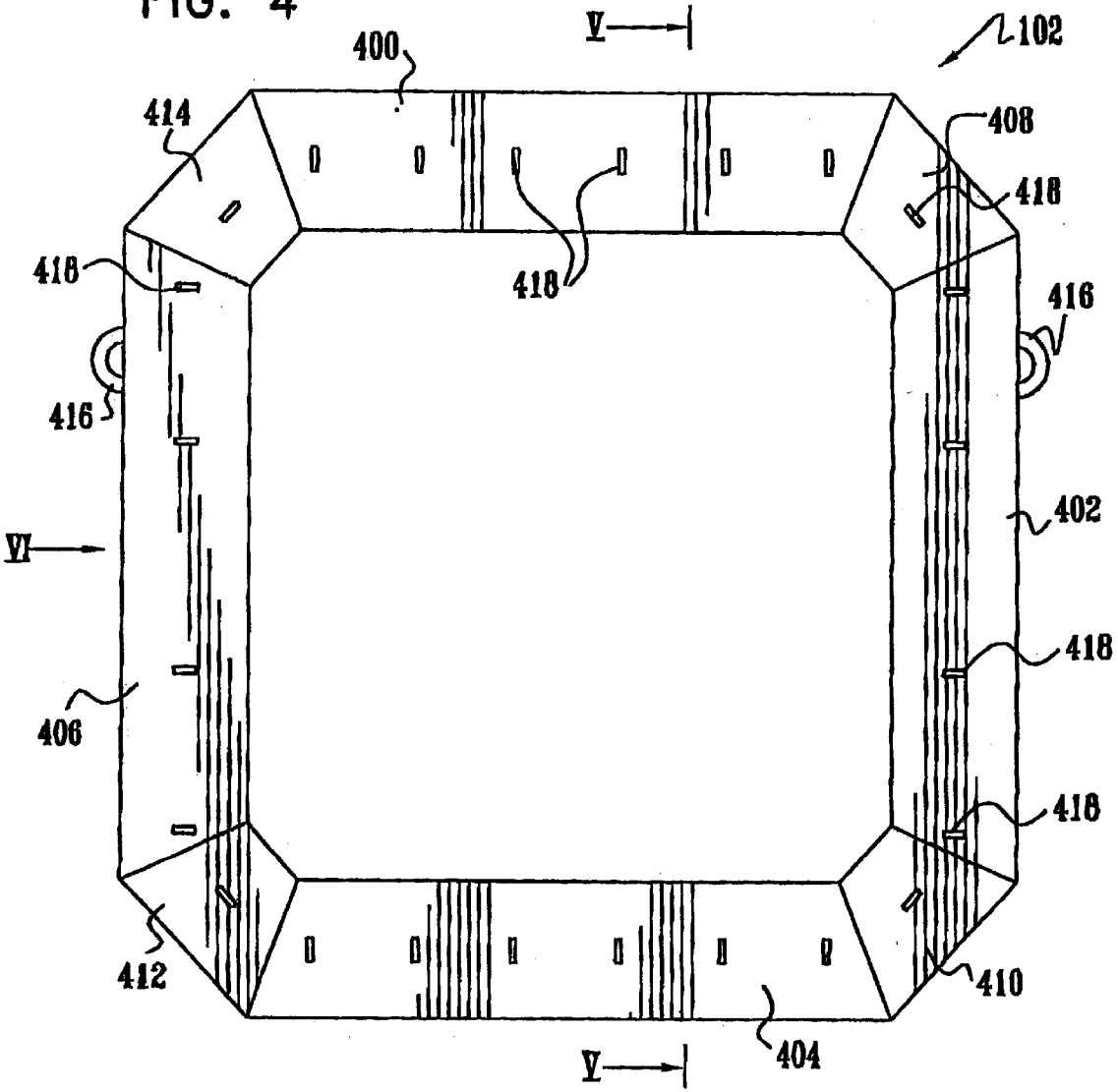
FIG. 4 is an illustration of an enclosure cross-section defining element taken along lines IV—IV in FIG. 1.
Figure 6:
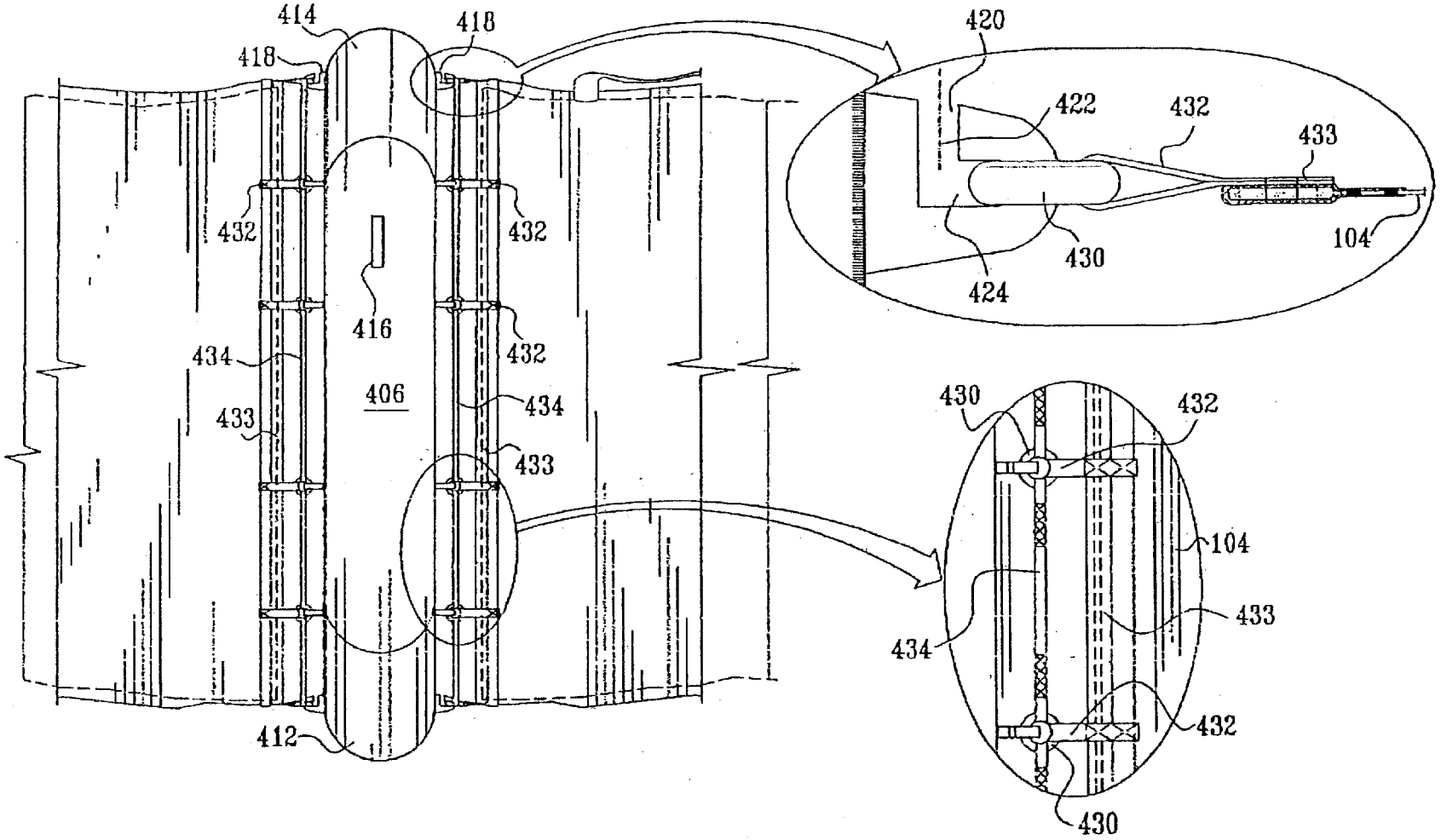
FIG. 6 is a side view illustration taken in the direction of arrow VI in FIG. 4.

Reference is now made to FIGS. 4–6 which illustrate an enclosure cross-section defining element 102, constructed and operative in accordance with a preferred embodiment of the present invention.

As seen in FIGS. 4–6, the cross-section defining element 102, is preferably a generally square structure having four elongate generally tubular portions 400, 402, 404 and 406 joined by four corner joining portions 408, 410, 412 and 414, all of which are preferably welded or bolted together. The two generally vertically disposed tubular portions 402 and 406 are preferably formed with attachment elements 416, suitable for attachment thereto of anchoring cables for anchoring the vessel 100 (FIGS. 4 and 5).

Distributed along side surfaces of tubular portions 400, 402, 404 and 406 and of corner joining portions 408, 410, 412 and 414 are a plurality of hooks 418. Preferably hooks 418 are formed of flat metal having at least a predetermined thickness and define an opening 420 extending along an axis 422 which communicates via an angled passageway 424 to a partially circular engagement space 426.

In accordance with a preferred embodiment of the present invention, hooks 418 are engaged by rings 430 through which extend attachment straps 432 which are preferably sewn onto flexible material 104 (FIG. 1) at spaced locations therealong, transversely to a tube attachment band 433 extending along the edge of flexible material 104 and covered by a folded over portion thereof. Tube attachment band 433 preferably has a tensile strength greatly in excess of that of flexible material 104.

In accordance with a preferred embodiment of the present invention, rings 430 are also engaged by reinforcing straps 434 which interconnect adjacent rings 430 and serve to generally prevent forces transverse to attachment straps 432 from producing detachment of bands 433 from the flexible material or tearing of the flexible material.

It is appreciated that according to an alternative embodiment of the present invention, the top portion of cross section defining element 102 may be obviated and replaced by a non-rigid structure, which is maintained rigid by the buoyancy of flesh water inside the vessel.

Figure 7A:
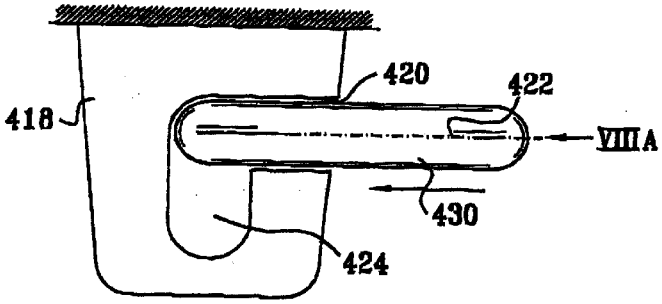
FIGS. 7A, 7B and 7C illustrate an engagement procedure useful in attaching a tube of flexible material to a cross-section defining elements.
Figure 8A:
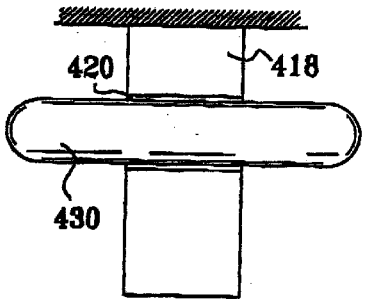
FIGS. 8A, 8B and 8C are drawings taken along lines VIIIA, VIIIB and VIIIC in FIGS. 7A, 7B and 7C respectively.

Reference is now made to FIGS. 7A–7C and 8A–8C, which illustrate an engagement procedure useful in attaching a tube of flexible material, such as that designated by reference numeral 104, to a cross-section defining element such as element 102. As seen in FIGS. 7A and 8A, the thickness of rings 430 is seen to be just less than the width of openings 420 in hooks 418, such that rings 430 may be slid through openings 420 when the plane of the ring is parallel to the axis 422 of the opening 420.

Figure 7B:
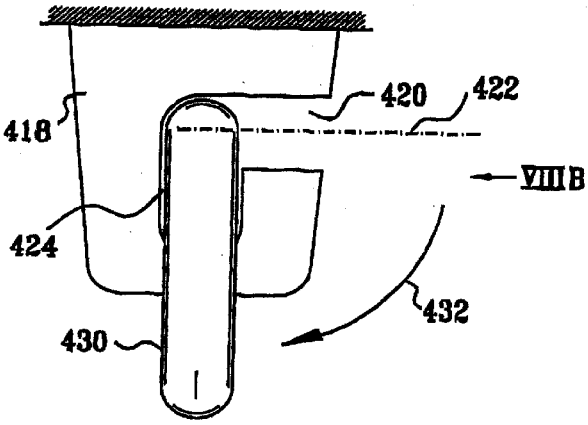
Figure 8B:
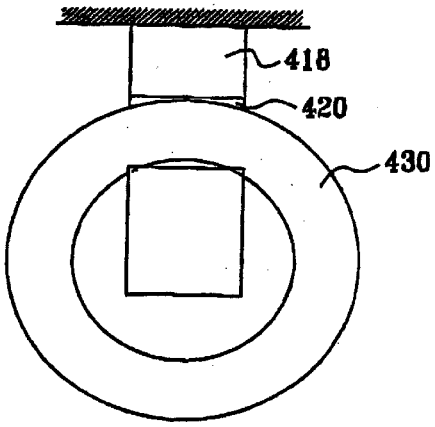
Figure 7C:
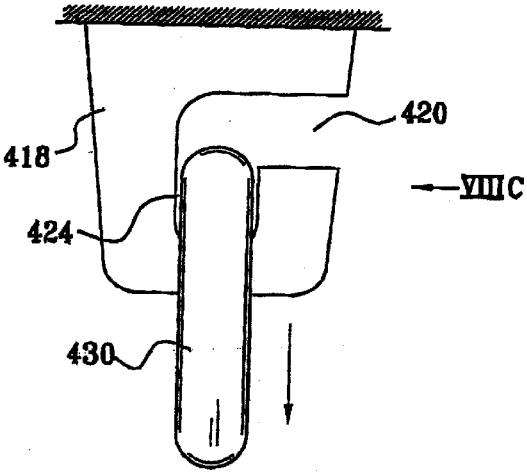
Figure 8C:
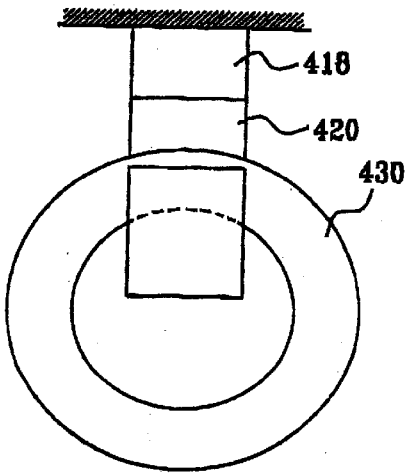

It is seen from a consideration of FIGS. 7B and 8B that when ring 430 is rotated by 90 degrees, as indicated generally by arrow 432, from its plane as shown in FIGS. 7A and 7B, to a plane in which it lies under tension, as seen in FIGS. 7C and 8C, the thickness of the hook 418, the width of the opening 420 and the curvature of the ring 430 prevent escape of the ring 430 via opening 420 as long as the ring remains under tension and thus in a plane rotated by 90 degrees from the plane parallel to axis 422.

Figure 9A:
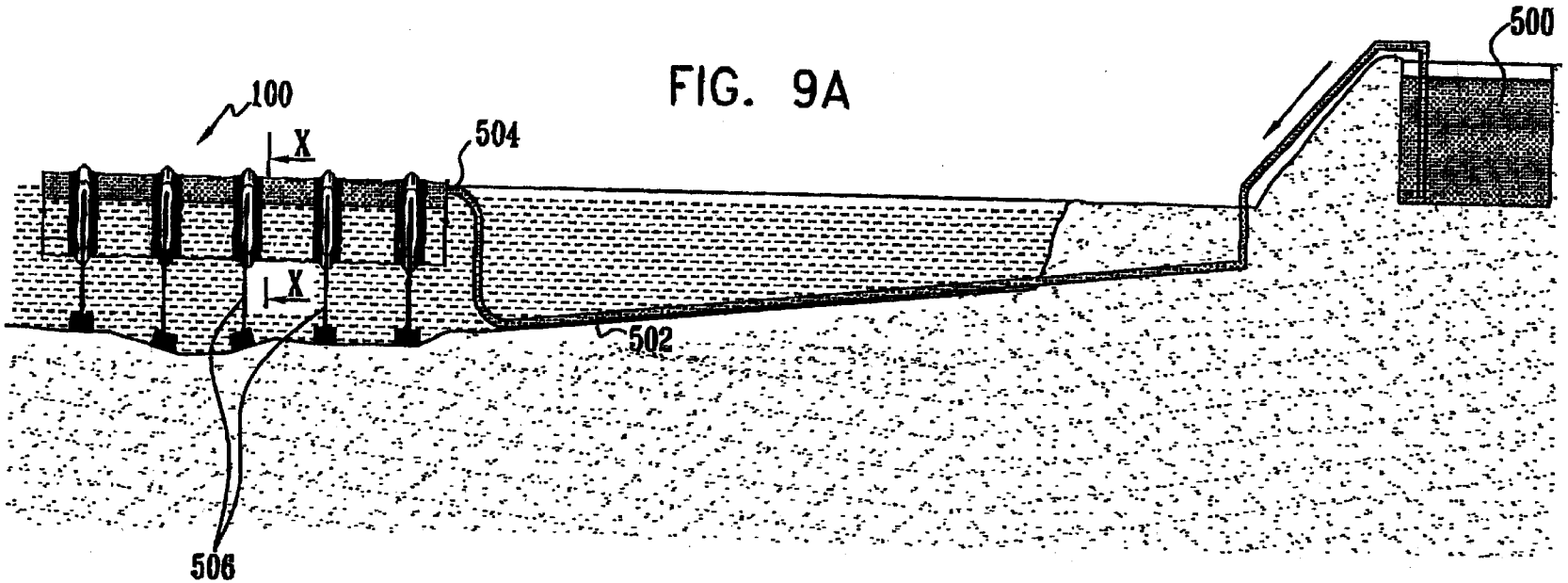
FIGS. 9A, 9B and 9C are simplified sectional illustrations showing loading, sea transport and unloading of fresh water from the vessel of FIGS. 1–6.
Figure 10A:
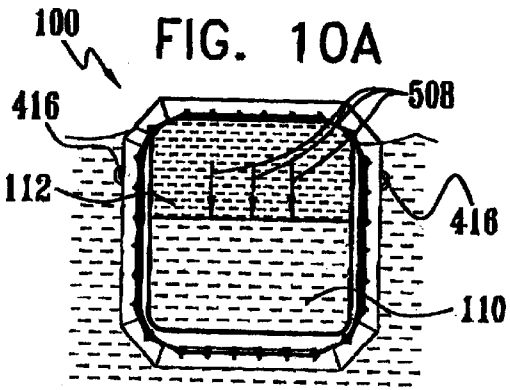
FIGS. 10A, 10B and 10C are simplified sectional illustrations taken along lines X—X in FIGS. 9A, 9B and 9C, showing the relative orientations of first and second enclosures at the stages shown in corresponding FIGS. 9A, 9B and 9C.

Reference is now made to FIGS. 9A–9C and 10A–10C, which are simplified sectional illustrations showing loading, sea transport and unloading of fresh water from the vessel of FIGS. 1–6. As seen in FIGS. 9A and 10A, fresh water is preferably loaded onto vessel 100 by gravity from a tank 500 via a partially underwater feed line 502 to an inlet 504 formed at any suitable location on the vessel, above or below sea level. At the time of loading, the vessel 100 is preferably anchored to the sea floor by means of cables 506, which engage attachment elements 416 (FIG. 4).

As seen particularly in FIG. 10A, as fresh water fills the vessel from the top of the flexible second enclosure 112 (FIGS. 2A and 2B) disposed within the first enclosure 110 (FIGS. 2A and 2B), the bottom of flexible second enclosure 112 moves downward as indicated by arrows 508, to generally fill the first enclosure 110.

Figure 9B:
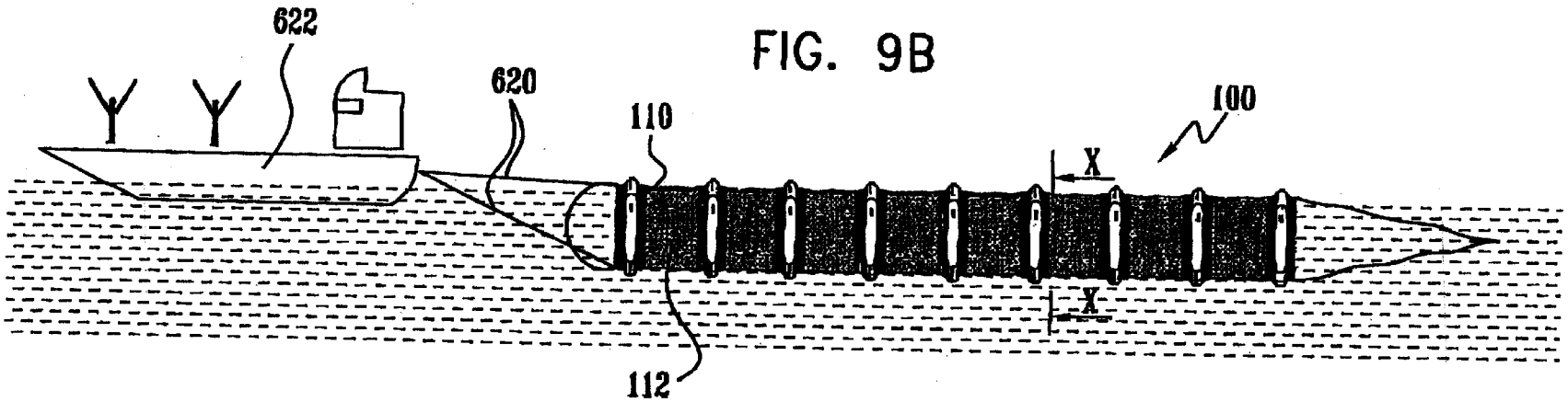
Figure 10B:
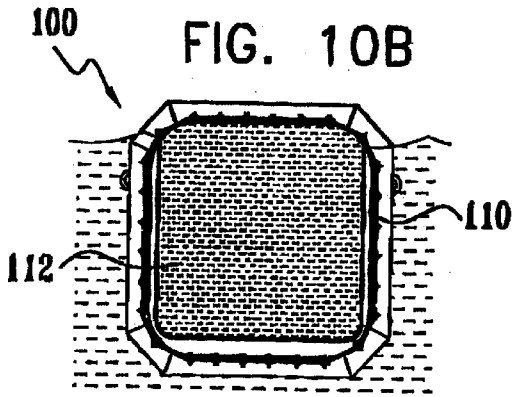

FIG. 9B shows that during sea transportation of the vessel 100, the vessel 100 is typically attached by cables 620 to a transportation ship 622. Additionally, as seen in FIGS. 9B and 10B during sea transport of fresh water, the second enclosure 112 fills all of the first enclosure 110.

Figure 9C:
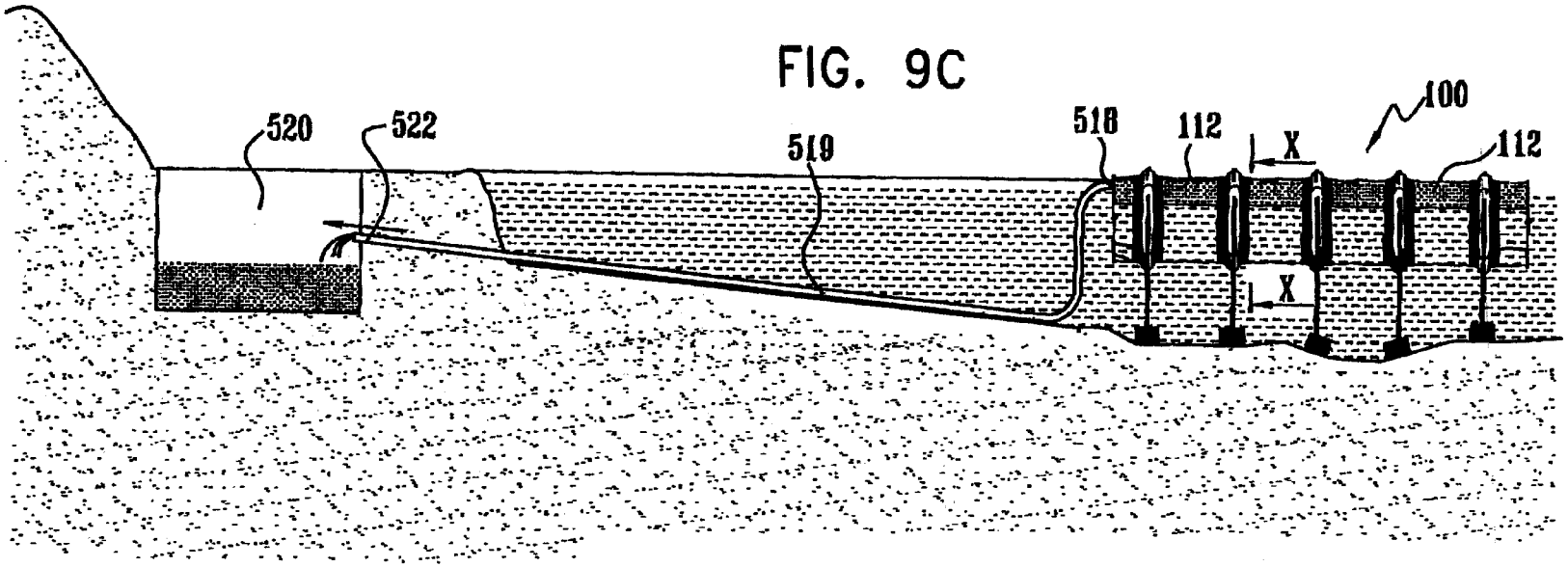
Figure 10C:
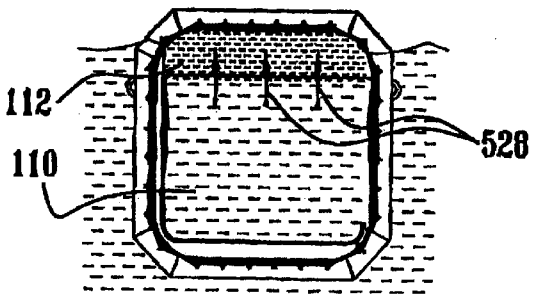

Turning to FIGS. 9C and 10C, it is seen that unloading of fresh water from vessel 100 is achieved without requiring pumps, by virtue of the buoyancy of fresh water over sea water. As seen in FIGS. 9C and 10C, fresh water is removed from an outlet port which may be identical to port 504 (FIG. 9A), located at the top of the second enclosure 112 via an at least partially underwater unloading line 519 to a tank 520 at an outlet 522 which lies below sea level.

As seen particularly in FIG. 10C, as sea water fills the first enclosure 110 of the vessel from below the flexible second enclosure 112, the bottom of the flexible second enclosure 112 moves upward as indicated by arrows 528, to minimize its volume within the first enclosure 110.

Figure 11:
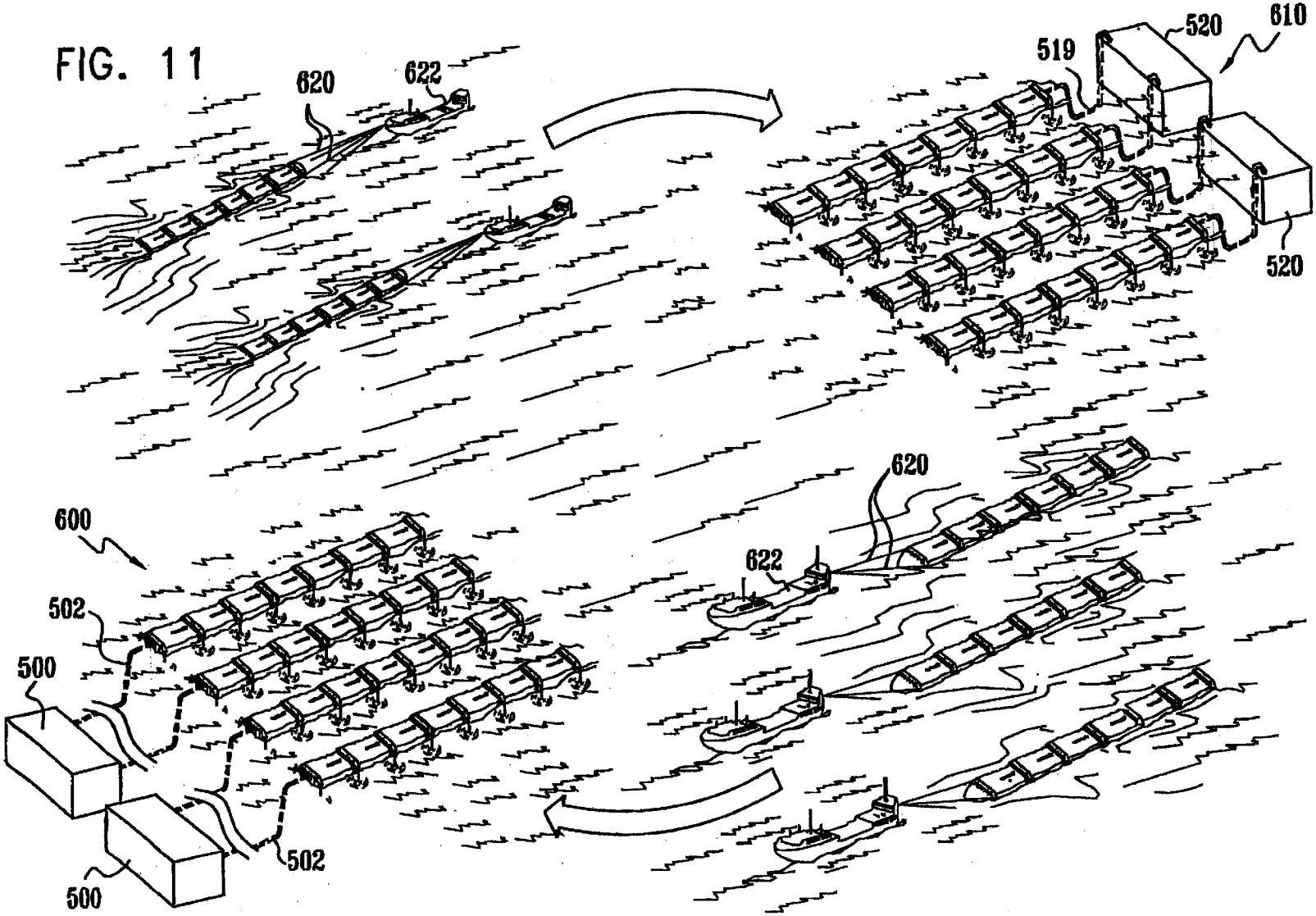
FIG. 11 is a pictorial illustration of a transport network employing the vessels and methodologies of FIGS. 1–10C.

Reference is now made to FIG. 11, which is a pictorial illustration of a transport network employing the vessels and methodologies of FIGS. 1–10C. It is seen that typically plural vessels 100 are located at both filling and unloading ports, designated respectively 600 and 610, so that plural vessels may be loaded and unloaded simultaneously and while other vessels travel between ports.

It will be appreciated by persons skilled in the art that the present invention is not limited by what has been particularly shown and described hereinabove. Rather the scope of the present invention includes both combinations and subcombinations of the various features described hereinabove as well as variations and modifications which would occur to persons skilled in the art upon reading the specification and which are not in the prior art.

What is claimed:

1. Apparatus for sea transport of liquids comprising:

a first flexible enclosure including:

a plurality of mutually spaced enclosure cross-section defining elements which are joined by a tube of flexible material;

an at least partially flexible second enclosure element disposed within said first enclosure, said first enclosure and said second enclosure element together defining an uppermost enclosure, being a light liquid enclosure, and a lowermost enclosure, being a sea water enclosure; and a light liquid port coupled to said light liquid enclosure for selectably filling it with a liquid lighter than sea water, said sea water enclosure being arranged for selectably allowing sea water to fill it, thereby causing light liquid to be expelled against the force of gravity from said light liquid enclosure.

2. Apparatus according to claim 1 and wherein said tube of flexible material is attached to said cross-section defining elements by means of an attachment assembly.

3. Apparatus according to claim 2 and wherein said attachment assembly comprises:

a tube attachment band overlapped with at least one portion of said flexible material and having a tensile strength greatly in excess of that of said flexible material;

a plurality of spaced attachment straps joined at least to said at least one edge portion of said flexible material and to said attachment band and extending generally perpendicularly to said attachment band, said attachment straps having a tensile strength greatly in excess of that of said flexible material;

a plurality of rings, each ring being engaged by one of said plurality of attachment straps;

ring attachment straps interconnecting said plurality of rings and having a tensile strength greatly in excess of that of said flexible material.

4. Apparatus according to claim 3 and wherein said cross-section defining elements are each formed with a plurality of hooks for engaging said rings.

5. Apparatus according to claim 4 and wherein said hooks and said rings are dimensioned so as to enable a ring to disengage from a hook only when not tensioned in a direction perpendicular to a plane of said cross-section defining elements.

6. Apparatus according to claim 1 and wherein said tube is an integral tube which extends along a length of said flexible enclosure.

7. Apparatus according to claim 1 and wherein said tube comprises a plurality of tube sections, each of which is attached at opposite edges thereof to a cross-section defining element.

8. Apparatus according to claim 1 and wherein said flexible enclosure is formed with at least one overpressure release assembly.

9. Apparatus according to claim 1 and wherein at least one of said light liquid enclosure and said sea water enclosure extends along generally the entire length of the first enclosure.

10. Apparatus according to claim 1 and wherein at least one of said light liquid enclosure and said sea water enclosure is divided into a plurality of compartments extending serially along generally the entire length of the first enclosure.

11. Apparatus for transport of liquids comprising:

a flexible enclosure including a plurality of spaced, relatively rigid enclosure cross-section defining elements, each pair of which are joined by a tube of flexible material and wherein said flexible enclosure is formed to define therewithin first and second fluid enclosures, an uppermost one of the first and second fluid enclosures being a light liquid enclosure and a lowermost one of the first and second fluid enclosures being a sea water enclosure, each of which may be filled to generally fill the flexible enclosure and thus empty the other of said first and second fluid enclosures.

12. Apparatus according to claim 11 and wherein said tube of flexible material is attached to said cross-section defining elements by means of an attachment assembly.

13. Apparatus according to claim 12 and wherein said attachment assembly comprises:

a tube attachment band overlapped with at least one portion of said flexible material and having a tensile strength greatly in excess of that of said flexible material;

a plurality of spaced attachment straps joined at least to said at least one edge portion of said flexible material and to said attachment band and extending generally perpendicularly to said attachment band, said attachment straps having a tensile strength greatly in excess of that of said flexible material;

a plurality of rings, each ring being engaged by one of said plurality of attachment straps;

ring attachment straps interconnecting said plurality of rings and having a tensile strength greatly in excess of that of said flexible material.

14. Apparatus according to claim 13 and wherein said cross-section defining elements are each formed with a plurality of hooks for engaging said rings.

15. Apparatus according to claim 14 and wherein said hooks and said rings are dimensioned so as to enable a ring to disengage from a hook only when not tensioned in a direction perpendicular to a plane of said cross-section defining elements.

16. Apparatus according to claim 11 and wherein said tube is an integral tube which extends along a length of said flexible enclosure.

17. Apparatus according to claim 11 and wherein said tube comprises a plurality of tube sections, each of which is attached at opposite edges thereof to a cross-section defining element.

18. Apparatus according to claim 11 and wherein said flexible enclosure is formed with at least one overpressure release assembly.

19. Apparatus according to claim 11 and wherein at least one of said first and second enclosures extends along generally the entire length of the flexible enclosure.

20. Apparatus according to claim 11 and wherein at least one of said first and second enclosures is divided into a plurality of compartments extending serially along generally the entire length of the flexible enclosure.

21. A method for transport of liquids over seas comprising:

providing a vessel including:

a first flexible enclosure including:

a plurality of mutually spaced enclosure cross-section defining elements which are joined by a tube of flexible material; and an at least partially flexible second enclosure element disposed within said first enclosure, said first enclosure and said second enclosure element together defining an uppermost enclosure, being a light liquid enclosure, and a lowermost enclosure, being a sea water enclosure;

loading said vessel by selectably filling said light liquid enclosure with a liquid lighter than sea water; and unloading said vessel by selectably allowing sea water to fill said sea water enclosure, thereby causing light liquid to be expelled against the force of gravity from said light liquid enclosure.

22. A method according to claim 21 and wherein said loading takes place principally by gravity and said unloading take place principally without requiring pumping.

23. A method according to claim 21 and wherein during travel of said vessel from a loading location to an unloaded location, the vessel is nearly completely underwater.

24. A method according to claim 21 and wherein said tube of flexible material is attached to said cross-section defining elements by means of an attachment assembly.

25. A method according to claim 24 and wherein said attachment assembly comprises:

a tube attachment band overlapped with at least one portion of said flexible material and having a tensile strength greatly in excess of that of said flexible material;

a plurality of spaced attachment loops joined at least to said at least one edge portion of said flexible material and to said attachment band and extending generally perpendicular to said attachment band, said attachment loops having a tensile strength greatly in excess of that of said flexible material;

a plurality of rings, each ring being engaged by one of said plurality of attachment loops;

a ring attachment band interconnecting said plurality of rings and having a tensile strength greatly in excess of that of said flexible material.

26. A method according to claim 25 and wherein said cross-section defining elements are each formed with a plurality of hooks for engaging said rings.

27. A method according to claim 26 and wherein said hooks and said rings are dimensioned so as to enable a ring to disengage therefrom only when not tensioned in a direction perpendicular to a plane of said cross-section defining elements.

28. A method according to claim 21 and wherein said tube is an integral tube which extends along a length of said flexible enclosure.

29. A method according to claim 21 and wherein said tube comprises a plurality of tube sections, each of which is attached at opposite edges thereof to a cross-section defining element.

30. A method according to claim 21 and wherein said flexible enclosure is formed with at least one overpressure accommodating volume.

31. A method according to claim 21 and wherein at least one of said light liquid enclosure and said sea water enclosure extends along generally the entire length of the first enclosure.

32. A method according to claim 21 and wherein at least one of said light liquid enclosure and said sea water enclosure is divided into a plurality of compartments extending serially along generally the entire length of the first enclosure.

33. A method for water transport of fluids comprising:

providing a vessel including a flexible enclosure including a plurality of spaced, relatively rigid enclosure cross-section defining elements which are joined by a tube of flexible material, said flexible enclosure being formed to define therewithin first and second fluid enclosures, an uppermost one of the first and second fluid enclosures being a light liquid enclosure and a lowermost one of the first and second fluid enclosures being a sea water enclosure, each of which may be filled to generally fill the flexible enclosure and thus empty the other of said first and second fluid enclosures;

loading said vessel by selectably filling said first fluid enclosure of a first fluid; and unloading said vessel by selectably allowing a second fluid to fill said second enclosure, thereby causing said first fluid to be expelled against the force of gravity from said first enclosure.

34. A method according to claim 33 and wherein said loading takes place principally by gravity and said unloading take place principally without requiring pumping.

35. A method according to claim 33 and wherein during travel of said vessel from a loading location to an unloaded location, the vessel is nearly completely underwater.

36. A method according to claim 33 and wherein said first enclosure is a flexible enclosure.

37. A method according to claim 36 and wherein said flexible enclosure comprises a plurality of mutually spaced enclosure cross-section defining elements which are joined by a tube of flexible material.

38. A method according to claim 37 and wherein said tube of flexible material is attached to said cross-section defining elements by means of an attachment assembly.

39. A method according to claim 38 and wherein said attachment assembly comprises:

a tube attachment band overlapped with at least one portion of said flexible material and having a tensile strength greatly in excess of that of said flexible material;

a plurality of spaced attachment loops joined at least to said at least one edge portion of said flexible material and to said attachment band and extending generally perpendicular to said attachment band, said attachment loops having a tensile strength greatly in excess of that of said flexible material;

a plurality of rings, each ring being engaged by one of said plurality of attachment loops;

a ring attachment band interconnecting said plurality of rings and having a tensile strength greatly in excess of that of said flexible material.

40. A method according to claim 39 and wherein said cross-section defining elements are each formed with a plurality of hooks for engaging said rings.

41. A method according to claim 40 and wherein said hooks and said rings are dimensioned so as to enable a ring to disengage therefrom only when not tensioned in a direction perpendicular to a plane of said cross-section defining elements.

42. A method according to claim 37 and wherein said tube is an integral tube which extends along a length of said flexible enclosure.

43. A method according to claim 37 and wherein said tube comprises a plurality of tube sections, each of which is attached at opposite edges thereof to a cross-section defining element.

44. A method according to claim 37 and wherein said flexible enclosure is formed with at least one overpressure accommodating volume.

45. A method according to claim 33 and wherein at least one of said light liquid enclosure and said sea water enclosure extends along generally the entire length of the first enclosure.

46. A method according to claim 33 and wherein at least one of said light liquid enclosure and said sea water enclosure is divided into a plurality of compartments extending serially along generally the entire length of the first enclosure.

* * * * *